US008977146B2

(12) United States Patent
Saeki

(10) Patent No.: US 8,977,146 B2
(45) Date of Patent: Mar. 10, 2015

(54) PRINTING APPARATUS

(71) Applicant: Masahito Saeki, Nagoya (JP)

(72) Inventor: Masahito Saeki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 4 days.

(21) Appl. No.: 14/010,934

(22) Filed: Aug. 27, 2013

(65) Prior Publication Data

US 2014/0064753 A1 Mar. 6, 2014

(30) Foreign Application Priority Data

Aug. 30, 2012 (JP) ..... 2012-190086

(51) Int. Cl.
*G03G 15/00* (2006.01)
*G03G 15/20* (2006.01)
*G03G 21/20* (2006.01)

(52) U.S. Cl.
CPC ..... *G03G 15/2039* (2013.01); *G03G 15/55* (2013.01); *G03G 15/6529* (2013.01); *G03G 21/20* (2013.01); *G03G 2215/00772* (2013.01); *G03G 2215/00949* (2013.01)
USPC ..... 399/43

(58) Field of Classification Search
USPC ..... 399/43
See application file for complete search history.

(56) References Cited

U.S. PATENT DOCUMENTS

2005/0117930 A1* 6/2005 Akizuki et al. ..... 399/69
2010/0239277 A1 9/2010 Mohri et al.

FOREIGN PATENT DOCUMENTS

JP 2005-091556 A 4/2005
JP 2009-031580 A 2/2009
JP 2010-244032 A 10/2010

* cited by examiner

*Primary Examiner* — Ryan Walsh
(74) *Attorney, Agent, or Firm* — Scully, Scott, Murphy & Presser, PC

(57) ABSTRACT

A printing apparatus includes: a conveyor configured to convey a sheet along a conveyance path; a driving device configured to drive the conveyor; a printing device configured to print an image on the sheet conveyed by the conveyor; and a controller. The controller executes a first processing in which, when a first indicator reaches a preset first value, the controller suppresses rise of a temperature in the printing apparatus. The first indicator is a value that changes based on an increase in the number of sheets printed by the printing device. The controller further executes a second processing in which the controller reduces frequency of execution of the first processing when the number of printings performed by the printing device within a set specific period is equal to or greater than a set reference number.

13 Claims, 8 Drawing Sheets

FIG.8

| | | Decrement of Count Value | Count Value |
|---|---|---|---|
| First One Minute | 1st sheet | ○ | 150→149 |
| | 2nd sheet | ○ | 149→148 |
| | 3rd sheet | ○ | 148→147 |
| | 4th sheet | ○ | 147→146 |
| | 5th sheet | ○ | 146→145 |
| | 6th sheet | ○ | 145→144 |
| | 7th sheet | ○ | 144→143 |
| | 8th sheet | ○ | 143→142 |
| | 9th sheet | ○ | 142→141 |
| | 10th sheet | ○ | 141→140 |
| | 11th sheet | × | 140 |
| | 12th sheet | × | 140 |
| | 13th sheet | × | 140 |
| | 14th sheet | × | 140 |
| | 15th sheet | × | 140 |
| | 16th sheet | × | 140 |
| | 17th sheet | × | 140 |
| | 18th sheet | × | 140 |
| | 19th sheet | × | 140 |
| | 20th sheet | × | 140 |
| Next One Minute | 21st sheet | ○ | 140→139 |
| | 22nd sheet | ○ | 139→138 |
| | 23rd sheet | ○ | 138→137 |
| | 24th sheet | ○ | 137→136 |
| | 25th sheet | ○ | 136→135 |
| | 26th sheet | ○ | 135→134 |
| | 27th sheet | ○ | 134→133 |
| | 28th sheet | ○ | 133→132 |
| | 29th sheet | ○ | 132→131 |
| | 30th sheet | ○ | 131→130 |
| | 31st sheet | × | 130 |
| | 32nd sheet | × | 130 |
| | 33rd sheet | × | 130 |
| | 34th sheet | × | 130 |
| | 35th sheet | × | 130 |
| | 36th sheet | × | 130 |
| | 37th sheet | × | 130 |
| | 38th sheet | × | 130 |
| | 39th sheet | × | 130 |
| | 40th sheet | × | 130 |

PRINTING APPARATUS

CROSS REFERENCE TO RELATED APPLICATION

The present application claims priority from Japanese Patent Application No. 2012-190086, which was filed on Aug. 30, 2012, the disclosure of which is herein incorporated by reference in its entirety.

BACKGROUND OF THE INVENTION

1. Field of the Invention

The present invention relates to a printing apparatus.

2. Description of the Related Art

There is conventionally known a technique for increasing the cumulative number of printings (i.e., printed sheets) each time when printing is performed on a sheet. In this technique, when the cumulative number of printings exceeds a permissible printing number, intermittent printing is performed, and when a detected temperature lowers to a temperature equal to or lower than a predetermined temperature, the cumulative number of printings is reset, and a normal recording operation is restarted.

SUMMARY OF THE INVENTION

The increase in the number of printings per unit time increases frequency of driving a motor, resulting in easier rise of a temperature in the apparatus. Thus, when the number of printings exceeds the permissible printing number, the intermittent printing is preferably performed to lower the temperature in the apparatus. However, after the number of printings per unit time reaches a predetermined number of times, the motor is continuously driven. Thus, even when the number of printings exceeds the predetermined number, the temperature in the apparatus rises only in the same degree as in a case where the number of printings is the predetermined number. Consequently, in the case where the number of printings per unit time is larger than the predetermined number, if the intermittent printing is performed without exception, frequency of the intermittent printing increases though the temperature in the apparatus does not rise greatly.

This invention has been developed to provide a technique for suppressing excessive rise of a temperature in an apparatus and for reducing frequency of executing a control for suppressing rise of the temperature in the apparatus.

The present invention provides a printing apparatus, including: a conveyor configured to convey a sheet along a conveyance path; a driving device configured to drive the conveyor; a printing device configured to print an image on the sheet conveyed by the conveyor; and a controller configured to execute: a printing processing in which the controller controls the driving device and printing device such that the number of printings per unit time is changed in a state in which the conveyor is driven at a predetermined speed; a first processing in which, when a first indicator reaches a preset first value, the controller suppresses rise of a temperature in the printing apparatus, wherein the first indicator is a value that changes based on an increase in the number of sheets printed within a set specific period in the printing processing; and a second processing in which the controller reduces frequency of execution of the first processing per unit number of printings when the number of printings performed within the set specific period in the printing processing is equal to or greater than a set reference number.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIG. 8 is a table illustrating the presence/absence of decrement and a count value for each number of printed sheets.

DETAILED DESCRIPTION OF THE EMBODIMENT

<One Embodiment>

Hereinafter, there will be described one embodiment of the present invention by reference to FIGS. 1-8.

1. Structure of Printer

Figure 1:
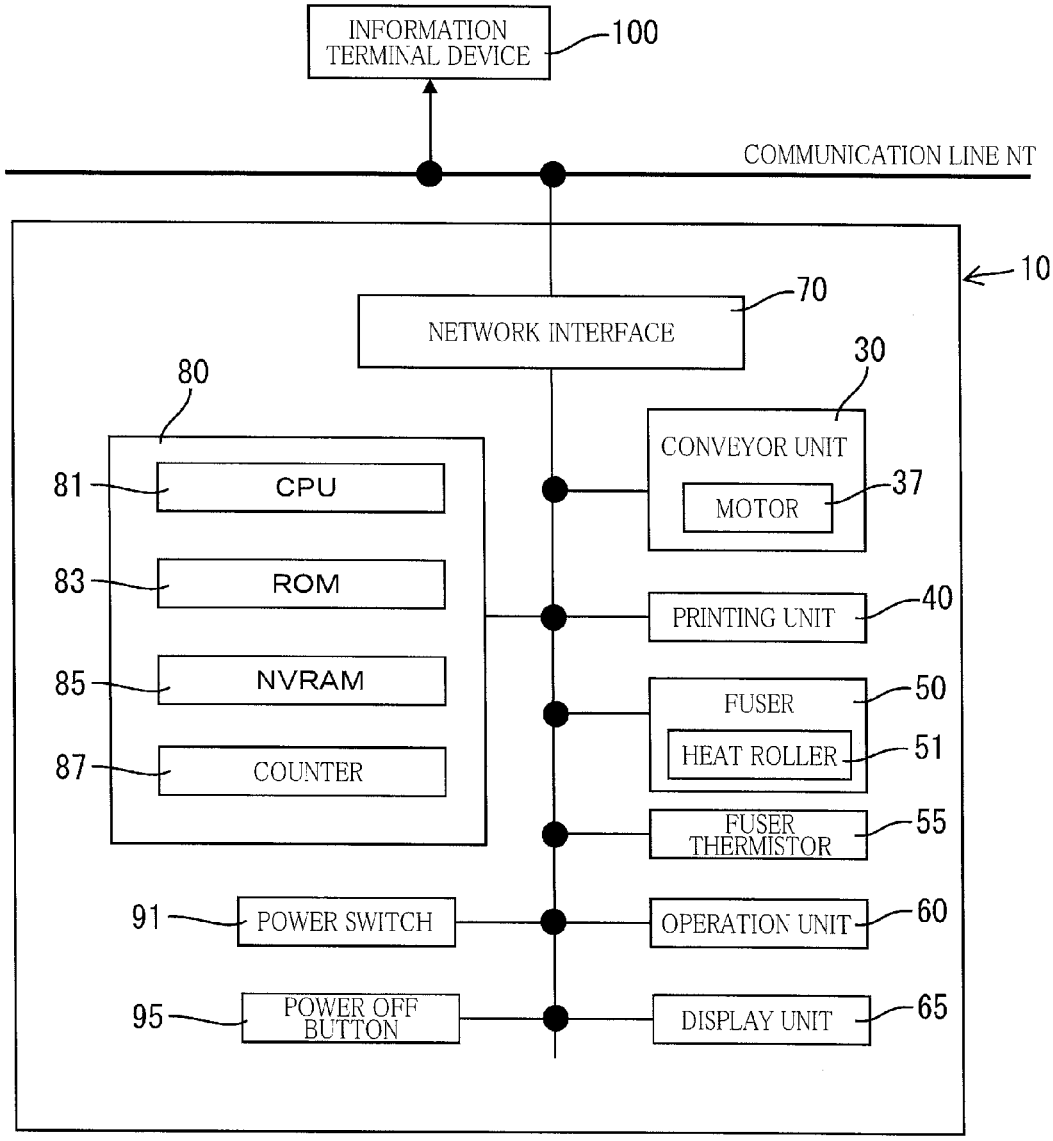
FIG. 1 is a block diagram illustrating an electric configuration of a printer according to one embodiment of the present invention.
Figure 2:
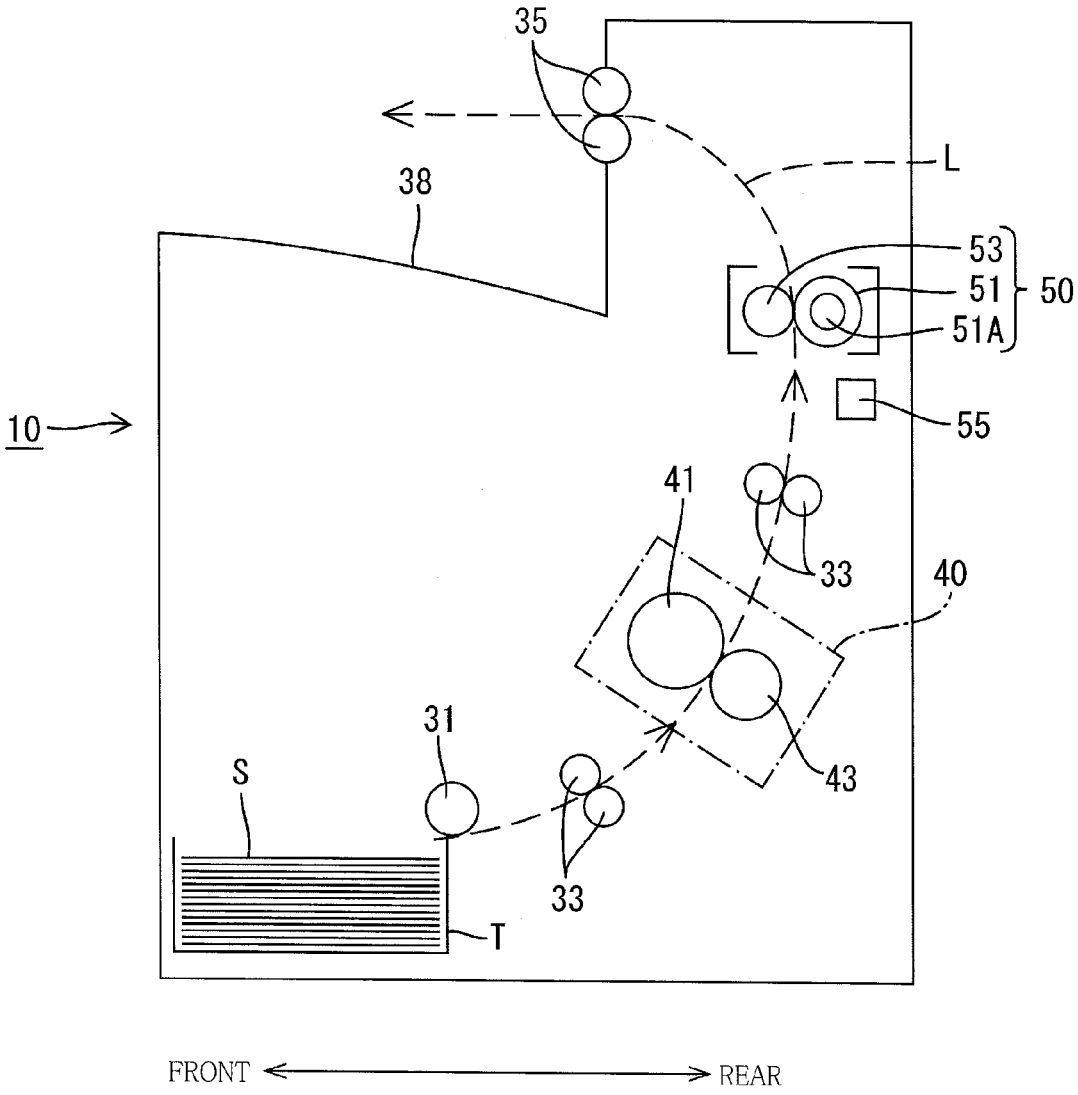
FIG. 2 is a cross-sectional view illustrating a main portion of the printer.

There will be explained a structure of a printer 10 with reference to FIGS. 1 and 2. The printer 10 includes a conveyor unit 30, a printing unit 40, a fuser (a fixing assembly) 50, a fuser thermistor 55, an operation unit 60, a display unit 65, a network interface 70, a controller 80, a power switch 91, and a power OFF button 95. The controller 80 is one example of a controller.

The conveyor unit 30 is configured to pick up sheets S (each as a recording medium) one by one from a tray T disposed in a lower portion of the printer 10 and convey the picked sheet S along a conveyance path L. The conveyor unit 30 includes: rollers such as a sheet-supply roller 31, conveyor rollers 33, and sheet-discharge rollers 35; and a motor 37 for rotating the rollers. The conveyor unit 30 is controlled by the controller 80 to convey the sheets S at the same speed regardless of the number of printing per unit time. It is noted that the motor 37 is one example of a driving unit.

The printing unit 40 is configured to utilize electrophotography to print an image (a toner image) on the sheet S conveyed along the conveyance path L. The printing unit 40 includes a photoconductor drum 41, a charging unit (not shown), a developing roller (not shown), and a transfer roller 43.

The fuser 50 is disposed downstream of the printing unit 40 and includes a heat roller 51 and a pressure roller 53. The heat roller 51 includes a heater (heating element) 51A in the form of, e.g., a halogen lamp which generates heat when energized. The fuser 50 is configured to use heat to fix the printed image (toner image) to the sheet S while the rollers 51, 53 are conveying the sheet S. The sheet S on which the toner is fixed using heat is discharged by the sheet-discharge rollers 35 onto a sheet-output tray 38 provided in an upper portion of the printer 10. Provided near the heat roller 51 is the fuser thermistor 55 that detects a temperature of the heat roller 51. The controller 80 uses the detected temperature to control the temperature of the heat roller 51.

The operation unit 60 is provided with a plurality of buttons and allows a user to perform various input operations such as a command for printing on the sheet S. The display unit 65 includes a liquid crystal display and a lamp and displays, for example, various setting screens and an operation state of the printer 10. The network interface 70 is coupled by a communication line NT to an information terminal device 100 such as a personal computer and a facsimile machine, allowing data communication between the network interface 70 and the information terminal device 100. The power switch 91 is for turning on a power source of the printer 10, and the power OFF button 95 is for turning off the power source of the printer 10.

The controller 80 is configured to control the printer 10 and includes a CPU 81, a ROM 83, a non-transitory NVRAM 85, and a counter 87. The ROM stores various programs for controlling the printer 10, and the NVRAM 85 can store various data such as a count value of the counter 87 (as one example of a first indicator). Upon receipt of a print job from the information terminal device 100, the CPU 81 of the controller 80 executes a print processing to print an image on the sheet S on the basis of print data.

2. Temperature-rise Suppression Processing and Reduction of Execution Frequency

Figure 3:
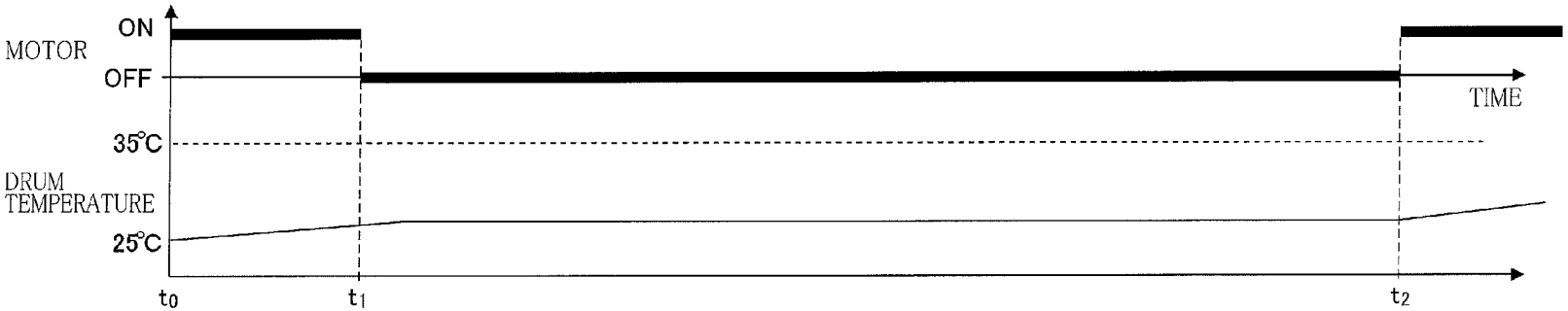
FIG. 3 is a view illustrating a relationship between an ON/OFF state of a motor and a drum temperature of a photoconductor drum.

As illustrated in FIG. 3, the motor 37 is driven and generates heat in printing on each sheet S. The graph in FIG. 3 represents changes of a drum temperature of the photoconductor drum 41 with a lapse of time with respect to timings of driving of the motor 37. As illustrated in FIG. 3, when the motor 37 starts to be driven at time $t_0$, the drum temperature gradually rises from time $t_0$, and when the driving of the motor 37 is stopped at time $t_1$, the drum temperature does not rise from time $t_1$. Thereafter, when the motor 37 starts to be driven again at time $t_2$, the drum temperature gradually rises from time $t_2$. In this way, the motor 37 is operated more frequently with increase in the number of printed sheets or pages (i.e., the number printings). Thus, the temperature in the printer 10 rises with the increase in the number of printed sheets. When the temperature in the printer 10 rises, the drum temperature of the photoconductor drum 41 and a toner temperature (i.e., a temperature of the toner) rise accordingly, which adversely affects image quality. To solve this problem, the rise of the temperature in the printer 10 is preferably suppressed. In the present printer 10, the counter 87 counts the number of printed sheets S, and when the count value reaches a threshold value as one example of a predetermined value, the controller 80 executes a temperature-rise suppression processing (as one example of a first processing) for suppressing the rise of the temperature in the printer 10. Specifically, the controller 80 executes an intermittent printing (S300-S340 in FIG. 7) in which printing is stopped for a predetermined length of time (30 seconds in this example) each time when a predetermined number of sheets S are printed (five sheets in this example). This processing can reduce the frequency of operations of the motor 37 to suppress the rise of the temperature in the printer 10.

In the present printer 10, a well-known detector such as a supply-sheet sensor and a discharge-sheet sensor detects the presence or absence of the sheet S conveyed along the conveyance path L. When the next sheet S is not supplied at the timing when a first sheet S is discharged by the sheet-discharge rollers 35, the controller 80 stops the motor 37.

Figure 4:
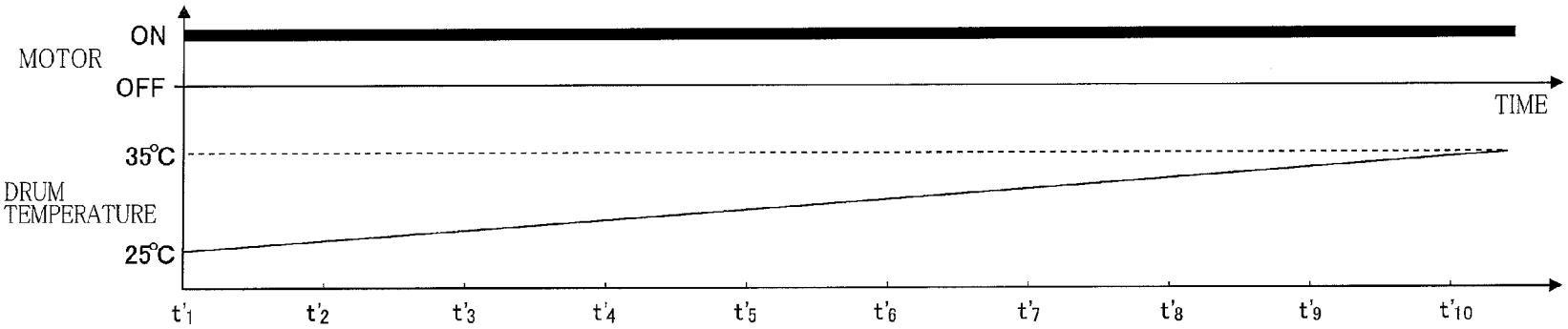
FIG. 4 is a view illustrating another relationship between the ON/OFF state of the motor and the drum temperature of the photoconductor drum.
Figure 5:
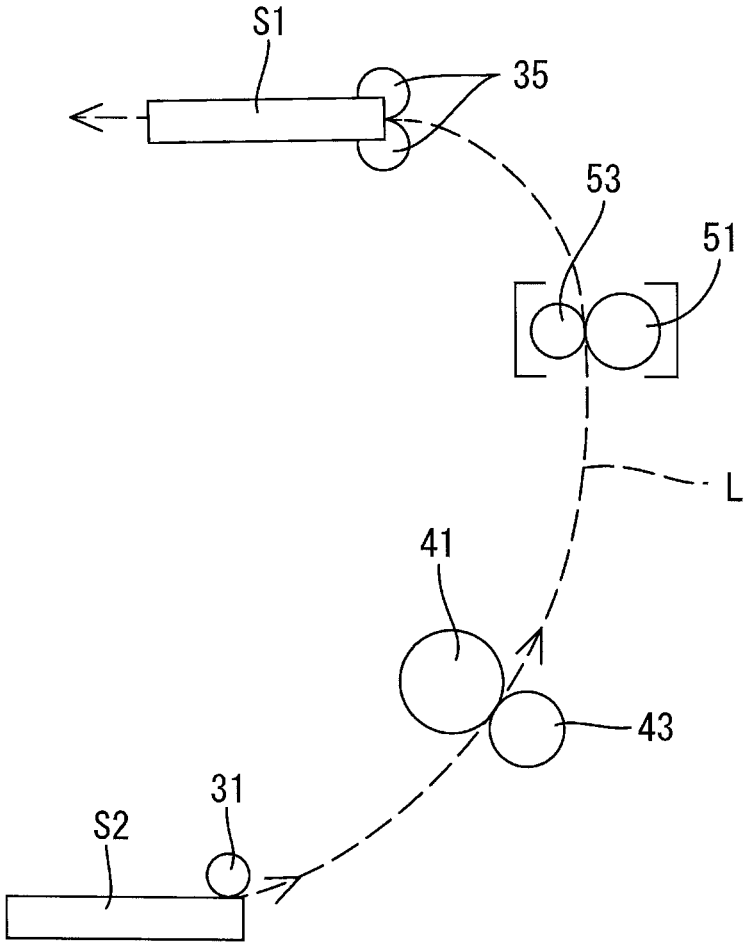
FIG. 5 is a view illustrating a situation in which, before a first sheet is discharged, the next sheet is supplied.
Figure 6:
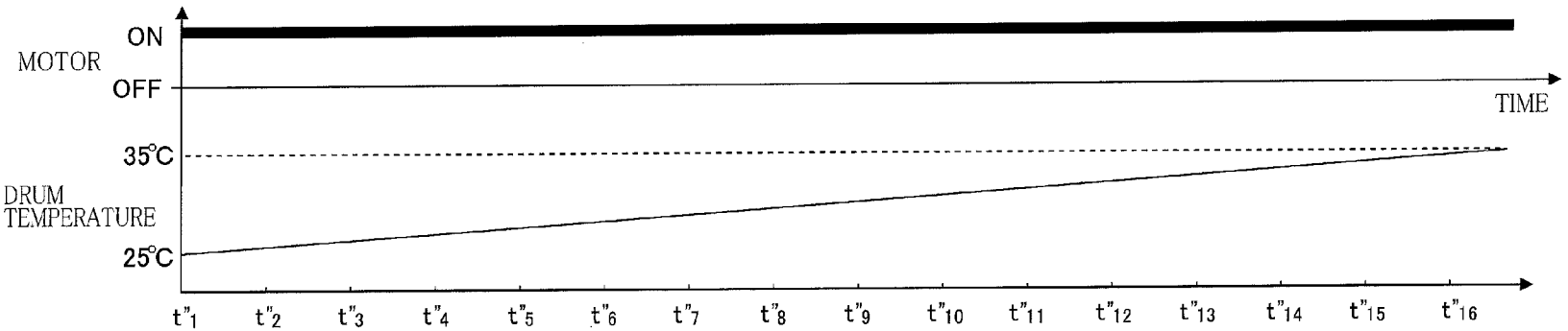
FIG. 6 is a view illustrating a relationship between the ON/OFF state of the motor and a rise in the temperature of the photoconductor drum.

As illustrated in FIG. 4, however, when the number of sheets S printed per unit time, e.g., one minute reaches a reference number (ten in this example), the motor 37 is continuously driven throughout the unit time. The graph in FIG. 4 represents that an nth ("n" is a natural number starting from one) one of sheets to be printed within a unit time (as one example of a set specific period) starts to be conveyed at time $t'_n$ (in other words, the driving of the motor 37 for the nth sheet is started at time $t'_n$). The continuous driving of the motor 37 throughout the unit time is caused for the following reason: in a case where the number of sheets S printed per unit time (as one example of the number of printings within the specific period) is the reference number (i.e., ten), a sheet conveying distance D (that is a distance along the conveyance path L between a first sheet Si and a second sheet S2 which are printed successively) is shorter than an entire length of the conveyance path L (i.e., a length from the sheet-supply roller 31 to the sheet-discharge rollers 35 along the conveyance path L), so that the second sheet S2 is supplied before the first sheet S1 is discharged. In other words, the reference number (i.e., ten) is set at a minimum number (minimum value) of sheets in which a time interval ($t'_n$-$t'_{n-1}$) between a time of start of conveyance for a first one of sheets S to be printed successively and a time of start of conveyance for a second one of the sheets S is shorter than a length of time required for the first sheet to be conveyed through the conveyance path L. FIG. 6 represents changes of the drum temperature of the photoconductor drum 41 with a lapse of time in a case where the number of printings (sixteen in FIG. 6) per unit time is larger than the reference number. The graph in FIG. 6 represents that an nth ("n" is a natural number starting from one) one of sheets to be printed within a unit time (as one example of the set specific period) starts to be conveyed at time $t''_n$ (in other words, the driving of the motor 37 for the nth sheet is started at time $t''_n$). Also in the example illustrated in FIG. 6, a time interval ($t''_n$-$t''_{n-1}$) between a time of start of conveyance for a first one of sheets S to be printed successively and a time of start of conveyance for a second one of the sheets S is shorter than the length of time required for the first sheet to be conveyed through the conveyance path L. As illustrated in FIGS. 4 and 6, a rate of the temperature rise in the printer 10 takes on a maximum value when the number of sheets S printed per unit time is the reference number (ten in this example). Also, when the number of printed sheets S (sixteen in this example) per unit time is equal to or larger than the reference number, the temperature in the printer 10 rises merely at about the same rate as in the case where the number of sheets S printed per unit time is ten. That is, when the number of sheets S printed per unit time becomes ten, the rate of the temperature rise peaks out, and even when the number of sheets S printed per unit time becomes larger than ten, the rate of the temperature rise does not change.

Accordingly, if, in the case where the number of sheets S printed per unit time is larger than the reference number, the counter 87 is counted on each printing by the same amount as in the case where the number of sheets S printed per unit time is equal to the reference number, the counter is counted more than necessary though the temperature in the printer 10 has risen in the same degree as in the case where the number of sheets S printed per unit time is equal to the reference number, resulting in higher frequency of the temperature-rise suppression processing than necessary. To solve this problem, where the number of sheets S printed per unit time is equal to or larger than the reference number, the present printer 10 executes an execution-frequency reduction processing (S70-

Figure 7:
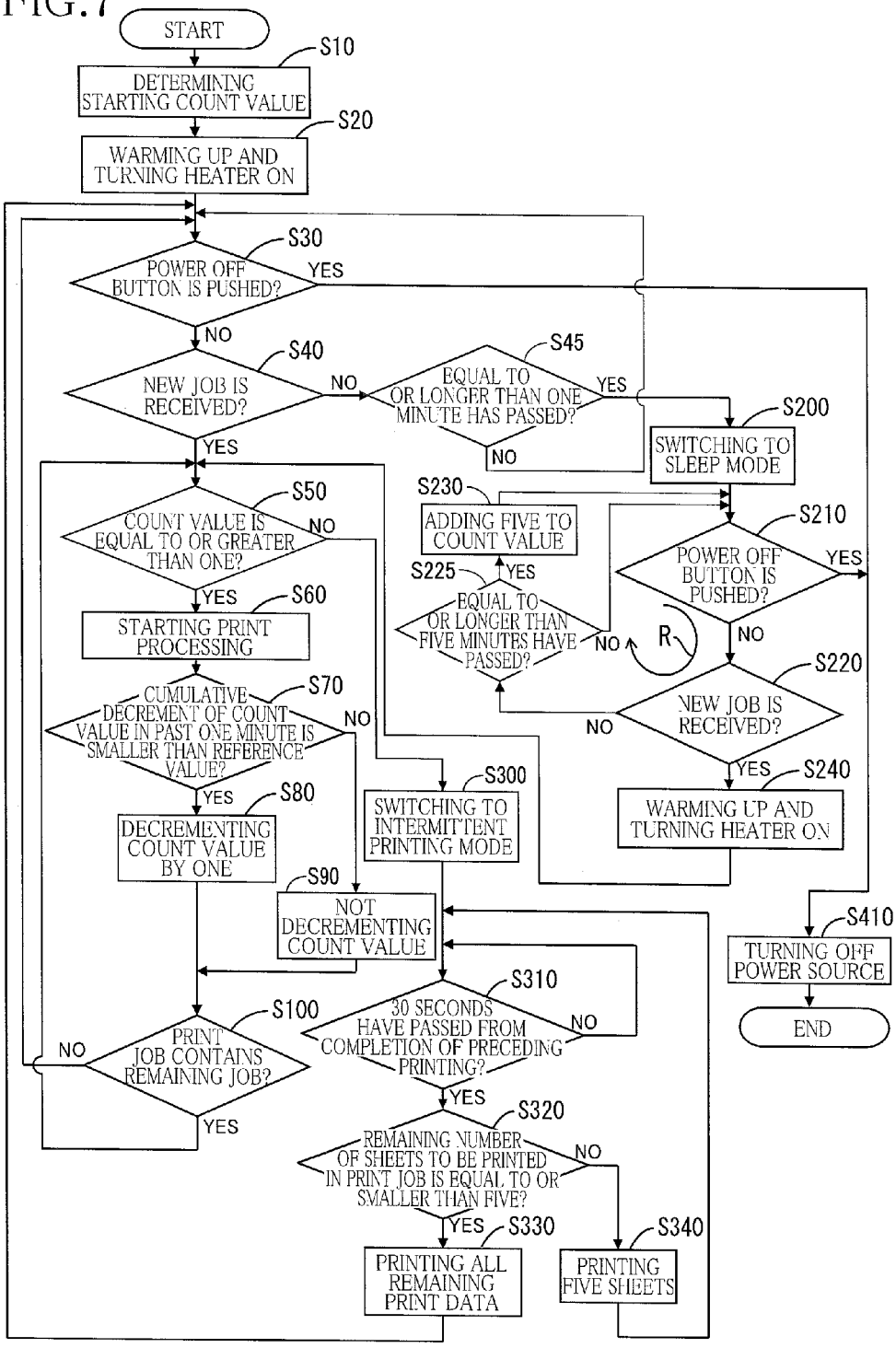
FIG. 7 is a flow chart illustrating a temperature-rise suppression sequence.

S90 in FIG. 7) as one example of a second processing for reducing frequency of executing the temperature-rise suppression processing.

It is noted that, as will be explained in description of a temperature-rise suppression sequence, in the case where the number of sheets S printed per unit time is equal to or larger than the reference number, the present printer 10 reduces the frequency of executing the temperature-rise suppression processing. Specifically, after the number of printings counted from a start of a certain unit time exceeds the reference number in the certain unit time, the counter 87 is not counted even when a sheet or sheets S are printed in the certain unit time (as one example of a second processing). In other words, the following processings are executed. For example, a timing NT1 is defined as a timing in which the next temperature-rise suppression processing is executed in a case where the value of the counter 87 is decremented by one upon each increase in the number of printings even when the number of sheets S printed per unit time is equal to or larger than the reference number unlike the present embodiment. Also, a timing NT2 is defined as a timing in which the next temperature-rise suppression processing is executed in the case where the value of the counter 87 is not decremented upon each increase in the number of printings when the number of sheets S printed per unit time is equal to or larger than the reference number as in the present embodiment. The next temperature-rise suppression processing is executed when the count value has reached zero (S50: NO in FIG. 7). Thus, the present printer 10 executes the processing (S90 in FIG. 7) for not decrementing the count value of the counter 87, whereby the timing NT2 of the temperature-rise suppression processing is made later than the timing NT1 that is in the case where the count value of the counter 87 is decremented, thereby reducing the frequency of executing the temperature-rise suppression processing.

3. Temperature-rise Suppression Sequence

There will be next explained, with reference to FIGS. 7 and 8, the temperature-rise suppression sequence which is executed by the controller 80. It is noted that the counter 87 takes on values from 0 to 150 in the present embodiment. Also, the counter 87 is of a countdown type and principally decrements (reduces) the value (i.e., counter value) of the counter 87 by one each time when the sheet S is printed. The threshold value of the counter 87 is set at zero (as one example of a first value), and when the counter value of the counter 87 becomes zero as the threshold value, the controller 80 switches a mode of the printer 10 from a normal printing mode to an intermittent printing mode. Also, the mode of the printer 10 includes a sleep mode in addition to the normal printing mode and the intermittent printing mode. The sleep mode is a mode for reducing power consumption by supplying electric power only to the network interface 70 and the controller 80 and stopping supply of the electric power to the other devices.

The temperature-rise suppression sequence illustrated in FIG. 7 begins when the power switch 91 is turned on. At S10, the controller 80 executes a processing for determining a starting count value. The starting count value is an initial value of the counter 87 and set at 150 in the present embodiment.

At S20, the controller 80 controls the printing unit 40 to warm up. Specifically, the controller 80 rotates the photoconductor drum 41 and stirs the toner. Also, the controller 80 at S20 turns on the heater 51A incorporated in the heat roller 51 of the fuser 50. As a result, the temperature of the fuser 50 rises.

At S30, the controller 80 determines whether the user has pushed the power OFF button 95 or not. When the power OFF button 95 has not pushed, a negative decision (NO) is made at S30, and this sequence goes to S40. At S40, the controller 80 determines whether a new print job has been received or not. When no new print job has been received, a negative decision (NO) is made at S40, and this sequence goes to S45. At S45, the controller 80 determines whether equal to or longer than one minute has been passed from the warm-up operation. When equal to or longer than one minute has been passed, a positive decision (YES) is made, and this sequence goes to S200. When equal to or longer than one minute has not been passed, a negative decision (NO) is made, and this sequence returns to S30. On the other hand, when a new print job has been received, a positive decision (YES) is made at S40, and this sequence goes to S50. The following explanation is provided assuming that a new print job has been received. It is noted that, in a case where printing has already been performed after the power switch 91 is turned on, the controller 80 at S45 determines whether or not equal to or longer than one minute has passed from the preceding printing.

At S50, the controller 80 determines whether or not the count value of the counter 87 is equal to or greater than one. In a case where a print job is received for the first time after the power switch 91 is turned on, a positive decision (YES) is made at S50 because the count value of the counter 87 is 150.

When the positive decision (YES) is made at S50, this sequence goes to S60 at which the print processing is started. As a result, a first sheet S is picked up from the tray T and supplied to a downstream side along the conveyance path L. The supplied sheet S passes through the printing unit 40 and the fuser 50 in order, and an image based on the print data is printed on the sheet S. The sheet S is then discharged onto the sheet-output tray 38 by the sheet-discharge rollers 35.

Also, the controller 80 executes the following processing in parallel with the above-described print processing. At S70, the controller 80 determines whether a cumulative decrement value of the counter 87 within one minute before this determination is smaller than the reference value or not. In other words, the controller 80 determines whether the cumulative decrement of the counter 87 within the unit time or one minute (as one example of the set specific period) including the current point in time is smaller than the reference value or not. The reference value of the counter 87 is set at ten because the reference number per unit time (i.e., the smallest one of the numbers (values) of printings per unit time which cause the motor 37 to be continuously rotated for one minute) is ten. When a print job is received for the first time after the power switch 91 is turned on, the count value of the counter 87 is 150 as the initial value. That is, the cumulative decrement of the counter 87 in past one minute is 0, and accordingly a positive decision (YES) is made at S70.

When the positive decision (YES) is made at S70, this sequence goes to S80. At S80, the controller 80 decrements the count value of the counter 87 by one (as one example of a changing manner). As a result, the count value of the counter 87 is changed from 150 to 149.

Then at S100, the controller 80 determines whether or not the print job contains a remaining job, i.e., print data corresponding to second and/or subsequent sheets S. When the print job contains the print data corresponding to the second and/or subsequent sheets S, a positive decision (YES) is made at S100.

In this case, this sequence goes to S50 at which the controller 80 again determines whether or not the count value of the counter 87 is equal to or greater than one. In a stage in which only one sheet has been printed after the power switch 91 is turned on, the count value of the counter 87 is decremented only by one and is 149. Thus, the positive decision (YES) is made at S50. When the positive decision (YES) is made at S50, this sequence goes to S60 at which the print processing is started for the second sheet S, and this sequence goes to S70 at which the controller 80 determines whether the cumulative decrement of the counter 87 in past one minute is smaller than the reference value (ten in this example) or not. Here, the maximum number of sheets S the present printer 10 can print per minute is twenty. Thus, where a plurality of sheets S are successively printed in one print job, the printer 10 can print up to twenty sheets per minute. In a stage in which the second sheet starts to be printed after the power switch 91 is turned on, the count value of the counter 87 is decremented only by one within past one minute. Thus, the positive decision (YES) is made at S70, and this sequence goes to S80.

At S80, the controller 80 decrements the count value of the counter 87 by one. As a result, the count value of the counter 87 is changed from 149 to 148.

Then at S100, the controller 80 determines whether or not the print job contains a remaining job, i.e., print data corresponding to third and/or subsequent sheets S. When the print job contains the print data corresponding to the third and/or subsequent sheets S, the positive decision (YES) is made at S100. Thereafter, when the positive decision (YES) is made at S50, this sequence goes to S60 at which the print processing is started for the third sheet S. This sequence then goes to S70 at which the controller 80 determines whether the cumulative decrement of the counter 87 in past one minute is smaller than the reference value (ten in this example) or not. In a stage in which the third sheet starts to be printed after the power switch 91 is turned on, the count value of the counter 87 is decremented only by two within past one minute. Thus, the positive decision (YES) is made at S70, and this sequence goes to S80.

At S80, the controller 80 decrements the count value of the counter 87 by one. As a result, the count value of the counter 87 is changed from 148 to 147.

In this printer 10 as described above, when the cumulative decrement of the counter 87 in past one minute is smaller than the reference value (ten in this example), the count value of the counter 87 is decremented by one each time when the sheet S is printed.

On the other hand, when the cumulative decrement of the counter 87 in past one minute is not smaller than the reference value (ten in this example), that is, when the cumulative decrement reaches the reference value, a negative decision (NO) is made at S70, and this sequence goes to S90. At S90, the controller 80 does not decrement the count value. Thus, when the cumulative decrement of the counter 87 in past one minute reaches ten as the reference value, the count value of the counter 87 is not changed (as one example of change of a changing manner). That is, as illustrated in FIG. 8, in a case where the printer 10 has a capability of printing twenty sheets within one minute and the printer 10 successively prints forty sheets S for one print job, the following operations are performed: for the first-tenth sheets S, the count value of the counter 87 is decremented by one each time when the sheet S is printed, but for the eleventh-twentieth sheets S, the count value of the counter 87 is not decremented each time when the sheet S is printed. Then, printing for the twenty-first sheet S is started, and the controller 80 determines whether the cumulative decrement of the counter 87 in past one minute is smaller than the reference value (ten in this example) or not. At this point in time, the processing for decrementing the count value of the counter 87 by one in response to the start of the printing for the first sheet S is considered to be a processing executed equal to or longer than one minute before the processing for the twenty-first sheet S. Thus, the cumulative decrement of the counter 87 in past one minute is nine that is smaller than the reference value, so that the count value of the counter 87 is decremented by one at S80 and changed from 140 to 139. Similar processings are executed for the twenty-second sheet S. That is, printing for the twenty-second sheet S is started, and the controller 80 determines whether the cumulative decrement of the counter 87 in past one minute is smaller than the reference value (ten in this example) or not. At this point, the processing for decrementing the count value of the counter 87 by one in response to the start of the printing for the second sheet S is considered to be a processing executed equal to or longer than one minute before the processing for the twenty-second sheet S. Thus, the cumulative decrement of the counter 87 in past one minute is nine that is smaller than the reference value, so that the count value of the counter 87 is decremented by one at S80 and changed from 139 to 138. The processings executed for the first through tenth sheets S are executed for the printings for the twenty-first through thirtieth sheets S. That is, each time when a sheet S is printed, the count value of the counter 87 is decremented by one, so that the count value of the counter 87 becomes 130 at printing for thirtieth sheet S. The processings executed for the eleventh through twentieth sheets S are executed for the printings for the thirty-first through fortieth sheets S. That is, even when the printing is performed, the count value is not decremented, so that the count value of the counter 87 is kept unchanged at 130.

As explained above, in the case where the printer 10 has the capability of printing twenty sheets per minute and the printer 10 successively prints the sheets S for one print job, the processing for decrementing the count value of the counter 87 by one each time when a sheet S is printed and the processing for not decrementing the count value even when a sheet S is printed are repeated in increments of ten sheets. Accordingly, in this case, when printings are successively performed for 290 sheets, the count value of the counter 87 becomes zero, and the mode of the printer 10 is switched to the intermittent printing mode. Conversely speaking, the printer 10 can successively print up to 290 sheets without being switched to the intermittent printing mode.

When the print processing is completed for all the print data contained in the print job, a negative decision (NO) is made at S100 upon the execution of the processing at S100. When the negative decision (NO) is made at S100, this sequence returns to S30 at which the controller 80 determines whether the user has pushed the power OFF button 95 or not.

When the user has not pushed the power OFF button 95, the controller 80 at S40 determines whether a print job has been received or not within one minute before this determination. When a print job has been received, the processings at S50 and subsequent steps are executed to execute the print processing. In a case where the controller 80 has executed a print processing for a print job containing image data representative of a lot of pages, or a plurality of print processings for print jobs each received within one minute from the preceding one of the print jobs, the value of the counter 87 is decremented and becomes zero. In this case, a negative decision (NO) is made at S50 upon the execution of the processing at S50, and the mode of the printer 10 is switched to the intermittent printing mode.

The intermittent printing mode is a mode for intermittently performing the printings on the sheets S. In the present embodiment, the motor 37 is stopped for 30 seconds each time when fives sheets S are printed. Specifically, the intermittent printing mode is composed of processings at S310-S340. First at S310, the controller 80 determines whether or not equal to or longer than 30 seconds have passed from completion of the preceding printing. When equal to or longer than 30 seconds have passed from the completion of the preceding printing, this sequence goes to S320. On the other hand, when equal to or longer than 30 seconds have not passed from the completion of the preceding printing, the processing at S310 is repeated.

At S320, the controller 80 determines whether or not the remaining number of sheets to be printed based on the print data contained in the print job is equal to or smaller than five. When the remaining number of sheets to be printed is larger than five, a negative decision (NO) is made at S320, and this sequence goes to S340. At S340, the motor 37 starts to be rotated again, and when five sheets S are printed, the motor 37 is stopped again. This sequence then goes to S310 at which the controller 80 determines whether or not equal to or longer than 30 seconds have passed from completion of the preceding printing. A negative decision (NO) is made at S310 until equal to or longer than 30 seconds have passed from the completion of the preceding printing. During this period, the motor 37 is stopped. When equal to or longer than 30 seconds have passed from the completion of the preceding printing, a positive decision (YES) is made at S310, and this sequence goes to S320. At S320, the controller 80 determines whether or not the remaining number of sheets to be printed based on the print data contained in the print job is equal to or smaller than five. When the remaining number of sheets to be printed is larger than five, this sequence goes to S340 at which the motor 37 starts to be rotated again, and when five sheets S are printed, the motor 37 is stopped again. The processings described above are repeated, so that the motor 37 is stopped for 30 seconds each time when five sheets are printed.

When the remaining number of sheets to be printed based on the print data contained in the print job is equal to or smaller than five, a positive decision (YES) is made at S320, and this sequence goes to S330. At S330, the motor 37 starts to be rotated again to print all the remaining print data. As a result, printing of all the print data contained in the print job is finished. This sequence then returns to S30.

In the present printer 10 as described above, when the count value of the counter 87 becomes zero as the threshold value, the mode of the printer 10 is switched to the intermittent printing mode for intermittently performing printing. Since the motor 37 as a heat source can be stopped, the rise of the temperature in the printer 10 can be suppressed. It is noted that the processings at S300-S340 are one example of the temperature-rise suppression processing (an intermittent print processing in this embodiment) as one example of a first processing.

Also, in the present printer 10, when the cumulative decrement of the counter 87 in past one minute is smaller than ten as the reference value, the count value of the counter 87 is decremented each time when a sheet S is printed, but when the cumulative decrement is equal to or larger than the reference value, the count value of the counter 87 is not decremented for printings on tenth and subsequent sheets within the one minute. This configuration increases the number of printings before the count value of the counter 87 reaches zero. For example, in a case where a processing for printing ten sheets within one minute is repeated, when 150 sheets have been printed, the count value of the counter 87 becomes zero, and the mode of the printer 10 is switched to the intermittent printing mode. In a case where a processing for printing twenty sheets within one minute is repeated, however, the count value of the counter 87 is decremented upon printings for only ten sheets. Accordingly, when 200 sheets have been printed, the count value of the counter 87 becomes zero, and the mode of the printer 10 is switched to the intermittent printing mode. In view of the above, this configuration can increase the number of printings executable before the switching to the intermittent printing mode, while performing the intermittent printing required for suppressing the rise of the temperature in the printer 10.

There will be next explained a case where a print job has not been received within one minute after printing of all the print data contained in the print job is finished. When a print job has not been received within one minute, a negative decision (NO) is made at S40, a positive decision (YES) is made at S45, and this sequence goes to S200.

At S200, the mode of the printer 10 is switched to the sleep mode in which electric power is supplied only to the network interface 70 and the controller 80, and no electric power is supplied to the other devices such as the motor 37 and the heater 51A.

At S210, the controller 80 determines whether the user has pushed the power OFF button 95 or not. When the power OFF button 95 is not pushed, this sequence goes to S220. At S220, the controller 80 determines whether a new print job has been received or not. When no new print job has been received, a negative decision (NO) is made at S220. When the negative decision (NO) is made at S220, this sequence goes to S225 at which the controller 80 determines whether equal to or longer than five minutes have passed since the mode of the printer 10 is switched to the sleep mode. When equal to or longer than five minutes have passed, a positive decision (YES) is made at S225, and this sequence goes to S230. At S230, the controller 80 adds five to the count value of the counter 87. On the other hand, when a negative decision (NO) is made at S225, and this sequence returns to S210. It is noted that, in a case where the count value of the counter 87 has already been incremented at S230 after the mode of the printer 10 is switched to the sleep mode, the controller 80 at S225 determines whether or not equal to or longer than five minutes have passed from the preceding increment of the count value.

In this processing, in a case where the count value of the counter 87 is 140, five added to the count value makes 145. In a case where the count value is 130, five added to the count value makes 135. It is noted that this addition is performed such that the count value does not exceed 150 as an upper limit value of the counter 87. That is, in a case where the count value is 147, three added to the count value makes 150.

This addition to the count value is performed for the following reason: when no print job has been received within five minutes after the mode of the printer 10 is switched to the sleep mode, the motor 37 and the heater 51A are continuously stopped for equal to or longer than five minutes, making it possible to assume that the temperature in the printer 10 has been lowered after the switch to the sleep mode even if the temperature in the printer 10 had risen with printing before the switch to the sleep mode.

When the controller 80 at S230 adds five to the count value of the counter 87, this sequence returns to S210. Accordingly, a loop R (illustrated in FIG. 3) for repeating the processings at S210, S220, S225, and S230 is made. This loop exits when the power OFF button 95 is pushed (S210: YES) or when a print job is received (S220: YES). In this loop, five is added to the count value of the counter 87 until the count value reaches the upper limit value "150", each time when five minutes passes after the mode of the printer 10 is switched to the sleep mode.

When the printer 10 receives a print job sent from the information terminal device 100, the sleep mode ends, and this sequence goes to the print processing. That is, a positive decision (YES) is made at S220, so that the loop R illustrated in FIG. 7 exits, and this sequence goes to S240. At S240, as in the processing at S20, the controller 80 controls the printing unit 40 to warm up. The controller 80 then executes processings at S50 and subsequent steps. When the power OFF button 95 is pushed by the user, on the other hand, a positive decision (YES) is made at S30 or S210, and this sequence goes to S410. At S410, the controller 80 turns off the power source, and the temperature-rise suppression sequence ends.

In the present embodiment, the count value of the counter 87 is stored into the NVRAM 85, and when the printer 10 is thereafter turned on, the count value stored in the NVRAM 85 is used or migrated.

In view of the above, the controller 80 can be considered to execute an indicator change processing (S80) for changing the count value when the number of sheets S printed per unit time is less than the reference number, such that the count value (i.e., a difference between the count value and the threshold value) is reduced by a predetermined amount upon each increase in the number of printings performed by the printing unit 40.

In the present embodiment explained above, in the case where the number of sheets S printed per unit time is equal to or larger than the reference number, the count value of the counter 87 is not decremented for the sheets printed after the reference number of printings within the unit time (one minute in this example). This configuration can increase the number of printings before the count value of the counter 87 becomes zero, that is, before the intermittent print processing is started.

Also, in the present printer 10, the sheet S is conveyed at a fixed speed regardless of the number of printings. In order to increase the number of printings per unit time in the case where the speed of the conveyance of the sheet S is constant, the sheet conveying distance D needs to be shortened. In other words, the time interval for conveyance of the sheet S needs to be shortened. When the sheet conveying distance D (or the time interval for conveyance) is shortened to increase the number of printings, the sheet conveying distance D becomes shorter than the length of the conveyance path L in many cases (or the time interval for conveyance becomes shorter than the length of time required for the sheet S to be conveyed through the conveyance path L), so that the motor 37 as one example of the driving unit continues to be driven. However, the temperature-rise suppression sequence of the printer 10 as the present embodiment can effectively increase the number of printings before the start of the intermittent print processing.

Where no sheet S is supplied when a sheet S is discharged from the conveyance path L, the controller 80 stops the motor 37 as one example of the driving unit. As a result, the motor 37 is stopped more frequently, making it difficult for the temperature in the printer 10 to rise.

<Other Modifications>

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, the following modifications also fall within the scope of the present invention.

(1) While the intermittent printing is one example of the temperature-rise suppression processing in the above-described embodiment, the temperature-rise suppression processing is not limited to the intermittent printing as long as the temperature rise is suppressed. For example, in a case where a cooling fan is provided, the fan may be driven instead of the intermittent printing.

(2) In the above-described embodiment, when the cumulative decrement of the counter 87 in past one minute is larger than the reference value, the count value of the counter 87 is not decremented for printings on the tenth and subsequent sheets within a unit time of one minute, thereby reducing the frequency of the intermittent print processing as the temperature-rise suppression processing. That is, the controller 80 changes how to count (i.e., the changing manner of the counter 87) depending upon whether the number of sheets S printed per unit time exceeds the reference number or not to reduce the frequency of executing the temperature-rise suppression processing. The present invention is not limited to this configuration as long as the frequency of executing the temperature-rise suppression processing is reduced in the case where the number of sheets S printed per unit time is equal to or larger than the reference number. For example, the threshold value of the counter 87 may be changed to reduce the frequency of executing the temperature-rise suppression processing. That is, in the case where the number of sheets S printed per unit time is equal to or larger than the reference number, the threshold value of the counter 87 may be changed to a value that reduces the frequency of executing the temperature-rise suppression processing. For example, in a case where the counter 87 is counted down in response to the print processing, the threshold value is set at a certain value at first, and when the number of sheets S printed per unit time is equal to or larger than the reference number, the threshold value is changed to a value smaller than the certain value.

(3) In the above-described embodiment, the counter 87 is counted down by one each time when a sheet is printed before the number of sheets S printed per unit time reaches the reference number. Also, when the number of printings on the sheets S exceeds the reference number, the counter 87 is not counted down, that is, the changing manner of the counter 87 is changed. The way of counting the counter 87 is not limited as long as the changing manner of the counter 87 is changed such that an amount of counting per sheet is made smaller in the case where the number of printings per unit time is equal to or larger than the reference number than in the case where the number of printings per unit time is smaller than the reference number. Specifically, the present invention is not limited to the above-described method in which the amount of counting per sheet (i.e., an average value of the amounts of counting) is reduced by not counting when the number of printings exceeds the reference number. For example, the amount of counting may be varied. Specifically, the printer may be configured such that, when the number of printings per unit time is smaller than the reference number, the amount of counting per sheet is determined at one, and when the number of printings per unit time is equal to or larger than the reference number, the amount of counting per sheet is determined at 0.5, for example.

(4) In the above-described embodiment, the controller 80 is constituted by the single CPU 81, the ROM 83, the NVRAM 85, and other similar devices, but the controller 80 may include a plurality of CPUs 81. Also, the controller 80 may be constituted by a combination of the CPU 81 and a hardware circuit(s) such as an ASIC or only by a hardware circuit(s).

(5) In the above-described embodiment, the threshold value is set at zero, and the controller 80 at S50 determines whether the count value is equal to or larger than one and at S70 determines whether the cumulative decrement of the counter 87 in past one minute is smaller than the reference value. Also, the controller 80 at S80 decrements the count value and at S230 increments the count value. The way of counting the count value is not limited to the way employed in the above-described embodiment, and the increment and the decrement may be interchanged. That is, the threshold value of the counter 87 is set at "151", and the controller at S50 determines whether the count value is smaller than "151" or not and at S70 determines whether cumulative increment of the counter 87 within one minute before this determination is equal to or smaller than the reference value. Then, the controller 80 at S80 increments the count value and at S230 decrements the count value.

What is claimed is:

1. A printing apparatus, comprising:

a conveyor configured to convey a sheet along a conveyance path;

a driving device configured to drive the conveyor;

a printing device configured to print an image on the sheet conveyed by the conveyor; and a controller configured to execute:

a printing processing in which the controller controls the driving device and printing device such that the number of printings per unit time is changed in a state in which the conveyor is driven at a predetermined speed;

a first processing in which, when a first indicator reaches a preset first value, the controller suppresses rise of a temperature in the printing apparatus, wherein the first indicator is a value that changes based on an increase in the number of sheets printed within a set specific period in the printing processing; and a second processing in which the controller reduces frequency of execution of the first processing per unit number of printings when the number of printings performed within the set specific period in the printing processing is equal to or greater than a set reference number.

2. The printing apparatus according to claim 1, wherein the reference number is a smallest one of numbers of printings which cause the driving device to drive the conveyor continuously over the set specific period.

3. The printing apparatus according to claim 1, wherein the reference number is a minimum number of printings in which a time interval between starts of successive conveyances by the conveyor for sheets to be printed successively is less than a length of time that is required for one of the sheets to be conveyed through the conveyance path.

4. The printing apparatus according to claim 1, wherein the controller is configured to execute an indicator change processing in which the controller changes the first indicator based on the increase in the number of sheets printed by the printing device to reduce a difference between the first indicator and the first value, and wherein the controller is configured to, when a changing manner in the indicator change processing is changed on condition that the number of printings within the specific period is equal to or greater than the reference number, execute the first processing with first frequency that is less than second frequency with which the first processing is executed when the changing manner is not changed even when the number of printings within the specific period is equal to or greater than the reference number.

5. The printing apparatus according to claim 1, wherein the controller is configured to execute an indicator change processing in which the controller changes the first indicator based on the increase in the number of sheets printed by the printing device to reduce a difference between the first indicator and the first value, and wherein the controller is configured to, when a changing manner in the indicator change processing is changed on condition that the number of printings within the specific period is equal to or greater than the reference number, start a next first processing at a first timing that is later than a second timing at which a next first processing is started when the changing manner is not changed even when the number of printings within the specific period is equal to or greater than the reference number.

6. The printing apparatus according to claim 5, wherein the changing manner when the number of printings within the specific period is equal to or greater than the reference number is changed from a changing manner of the first indicator when the number of printings within the specific period is less than the reference number, such that the next first processing is started at a later timing.

7. The printing apparatus according to claim 1, wherein the controller is configured to execute the second processing in which, when the number of printings within the specific period is equal to or greater than the reference number, the controller does not reduce the difference between the first indicator and the first value even when the number of sheets printed is increased.

8. The printing apparatus according to claim 7, wherein the controller is configured to execute the second processing in which, when the number of printings within the specific period is equal to or greater than the reference number, the controller inhibits the first indicator from being changed such that the difference between the first indicator and the first value is reduced, even when the number of sheets printed is increased.

9. The printing apparatus according to claim 1, wherein the controller is configured to, when the number of printings within the specific period is less than the reference number, change the first indicator to reduce the difference between the first indicator and the first value upon each increase in the number of sheets printed by the printing device.

10. The printing apparatus according to claim 1, wherein the controller is configured to, when the number of printings within the specific period is less than the reference number, change the first indicator to reduce a difference between the first indicator and the first value by a predetermined amount upon each increase in the number of sheets printed by the printing device, and wherein the controller is configured to execute the second processing in which, when the number of printings within the specific period is equal to or greater than the reference number, the controller reduces the predetermined amount used in the indicator change processing.

11. The printing apparatus according to claim 1, wherein the controller is configured to stop the driving device when a sheet to be printed by the printing device following a certain sheet is not supplied to the conveyance path at a timing when the certain sheet is discharged from the conveyance path.

12. The printing apparatus according to claim 1, wherein the controller is configured to control the conveyor to convey the sheet at a fixed speed.

13. The printing apparatus according to claim 1, wherein the controller is configured to execute the first processing in which, when the first indicator reaches the first value, the controller controls the driving device not to drive the conveyor for a specific period.

* * * * *